United States Patent [19]

Moraw et al.

[11] 4,298,217

[45] Nov. 3, 1981

[54] IDENTITY CARD

[75] Inventors: Roland Moraw; Helmut Walter, both of Wiesbaden, Fed. Rep. of Germany

[73] Assignee: Hoechst Aktiengesellschaft, Frankfurt am Main, Fed. Rep. of Germany

[21] Appl. No.: 70,737

[22] Filed: Aug. 29, 1979

[30] Foreign Application Priority Data

Sep. 6, 1978 [DE] Fed. Rep. of Germany ..... 2838795

[51] Int. Cl.[3] ..... G09F 3/02; B42D 15/00

[52] U.S. Cl. ..... 283/7; 40/2.2; 283/8 R; 283/9 R

[58] Field of Search ..... 40/2.2; 283/7, 8 R, 283/9 R

[56] References Cited

U.S. PATENT DOCUMENTS

| | | | |
|---|---|---|---|
| 3,068,140 | 12/1962 | Biddle | 283/7 X |
| 3,279,826 | 10/1966 | Rudershausen et al. | 283/7 |
| 3,457,661 | 7/1969 | Peters | 283/7 X |
| 3,461,581 | 8/1969 | Hoffmann | 283/7 X |
| 3,897,964 | 8/1975 | Oka et al. | 283/7 |
| 4,092,449 | 5/1978 | Bernstein | 283/8 B X |
| 4,096,015 | 6/1978 | Kawamata et al. | 40/2.2 X |
| 4,151,667 | 5/1979 | Idelson et al. | 40/2.2 |

FOREIGN PATENT DOCUMENTS

| | | | |
|---|---|---|---|
| 1963390 | 7/1970 | Fed. Rep. of Germany | 283/7 |
| 2163943 | 7/1972 | Fed. Rep. of Germany | 283/7 |
| 2308876 | 9/1973 | Fed. Rep. of Germany | 283/7 |
| 2613131 | 10/1977 | Fed. Rep. of Germany | 40/2.2 |
| 7426097 | 2/1976 | France | 283/7 X |

*Primary Examiner*—Paul A. Bell

*Attorney, Agent, or Firm*—Schwartz, Jeffery, Schwaab, Mack, Blumenthal & Koch

[57] ABSTRACT

The application discloses an identity card consisting of a plurality of layers, of which the cover layers are highly transparent films and the layers of the card core are films of moderate to low transparency, as a result of added pigment. One core layer carries information, which can be read directly, if desired, above a security print, while the other core layer has an additional security marking, such as a guilloche print, a marking which can be read optically only with the aid of a special lamp, or a piece of magnetic tape. All the layers consist of polymers which can be fused together to form a laminate which is fused together like a monolithic block and which does not have any interfaces which allow a mechanical, thermal or chemical separation.

13 Claims, 4 Drawing Figures

IDENTITY CARD

BACKGROUND OF THE INVENTION

The present invention relates to an identity card consisting of several layers and carrying, at a suitable point, information which serves to identify the card holder, and having additional security markings, such as guilloche figures, as a protective measure against forgeries.

Cards of this type are used as information carriers or data carriers for identity cards, cheque cards, credit cards, personal passes, passports and other identification carriers, and there must be security against forged cards. Also, it must be easy to check the authenticity of the cards.

Identity cards of this type are increasingly manufactured in the form of a fused laminate in which a card core carrying the information is protected by other transparent films. Thus, German Offenlegungsschrift No. 2,308,876 relates to an identity card consisting of a relatively thick carrier film and a thin transparent film, between which there is a special paper having internal features, such as watermarks, banknote printings or the like, which serve for protection against forgeries and cause differences in the thickness of the paper. The three layers are plastified together in such a way that the internal features are manually, mechanically and/or visually detectable through the transparent film. Further markings which serve to identify the card holder are provided at a suitable point on this known identity card. For example, a photograph in the form of a film transparency is inserted during plastifying between the special paper and the carrier film and is firmly bonded to the special paper. Furthermore, it is possible, at any desired point on the front or rear of the identity card, to laminate a strip of special paper, printed according to security technology, onto the outside of the plastic material, as a field for later insertion of signatures or other handwritten entries.

Paper has the advantage that numerous latent security markings, such as watermarks, banknote printings, security filaments and the like, can be contained therein, while, by contrast, the material which is used for the manufacture of plastic cards and consists entirely of plastic does not contain any authenticity or security markings of this type. When it is laminated to paper cores, it is unfortunately a disadvantage that these laminations can be opened up relatively easily and are thus accessible to manipulations and forgeries of any kind.

German Auslegeschrift No. 2,163,943 discloses a personal identity card which comprises a combination of a support layer, an electrically conductive layer, a barrier layer, a photoconductive layer with an organic photoconductor, optionally a cover layer, a protective layer on the photoconductive layer or on the cover layer, a protective layer on the rear of the layer support and, optionally, a cover layer on the last-mentioned protective layer. In this personal identity card, a number of different materials are assembled to give a laminate which, due to the lack of homogeneity of the individual layers, can be split up so that it is possible to carry out forgeries.

SUMMARY OF THE INVENTION

It is an object of the present invention to provide an improved identity card.

It is another object of the invention to provide an identity card consisting of a laminate of layers which withstand any attempt to separate them into individual layers and thus resist any interference due to forgery of the information and security markings fixed on the layers.

In accomplishing the foregoing objects, there has been provided in accordance with the present invention an identity card, comprising: a single monolithic body of synthetic resinous material containing at least one element of visible identifying indicia and, in the interior thereof, at least one element of a security indicia. This body is made by fusing together a first layer of heat plastifiable synthetic resinous material to a first surface of a second layer of heat plastifiable synthetic resinous material which contains the security indicia on the first surface thereof. Preferably, the card comprises a core comprised of the fused first and second layers and at least one cover layer formed by fusing to at least one outer surface of the core a third layer of heat plastifiable synthetic resinous material.

Other objects, features and advantages of the invention will become apparent from the following detailed description of preferred embodiments, when considered in light of the attached figures of drawing.

DETAILED DESCRIPTION OF PREFERRED EMBODIMENTS

In one embodiment of the invention, the card core is composed of at least two layers, of which one layer carries the information which directly serves for identification, such as the name, photograph and personal reference number, and the other layer carries additional latent security markings. The individual layers of the identity card have different transparencies; thus, for example, one of the two layers of the card core has a matt, preferably white, coloring as a result of added pigment and accordingly has a moderate to low transparency. By contrast, the upper cover layer and the optional lower cover layer of the identity card have a very high transparency.

In a further embodiment of the invention, the card core consists of three layers, of which one is a transparent interlayer which is bounded on at least one side by a matt layer of the type above described. The interlayer is here provided with latent security markings which are at a distance from one another, which is equal to the thickness of the interlayer. Additional security is provided for this identity card by the fact that the information or the security markings of the respective layers of the card core are in a fixed spatial relationship with respect to each other.

The cover layers can also be provided with security markings, and these security markings can be in a predetermined spatial arrangement relative to those security markings on the card core. To improve the security against forgeries, the information and the security markings have different colors.

It is obvious that it is impossible to attempt, for the purpose of forging the information present between the layers, to split open an identity card in which the card core and the upper cover layer and lower cover layer consist of polymers which have been fused together by heat to give a laminate, since the individual layers of material form a single homogeneous body.

Figure 1:
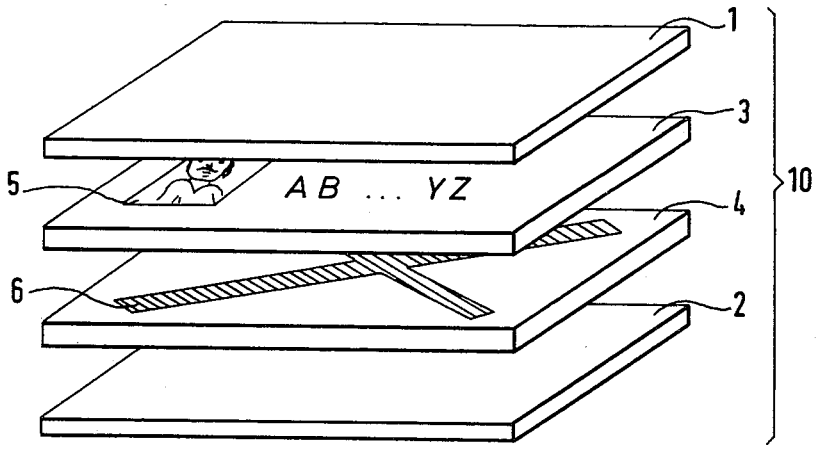
FIG. 1 is an exploded perspective view of an identity card according to the invention with diagrammatically indicated information and a security marking.

In the following text, the invention is explained in more detail with reference to two illustrative embodiments illustrated in the drawings. One construction of an identity card is shown in FIG. 1. The cover layers 1 and 2 of highly transparent films enclose a card core and consist of heat plastifiable polymers, for example, polyamides, polyvinyl chloride or the like, which can be fused together. The card core comprises two layers 3 and 4 of moderate to low transparency. These are likewise films of polymers which can be fused together. The layers 3 and 4 have a matt, preferably white, coloring as a result of added pigment. The layer 3 carries information 5 which can be read directly, such as the name, personal reference number and photograph of the card holder, which, if desired, are applied above a security print. At least one layer, which in FIG. 1 is layer 4, carries an additional latent security marking 6 which is indicated in FIG. 1 by an X. The layer 4 can additionally also contain printed indicia on the outside surface which faces the cover layer 2.

The additional security marking 6 can be, for example, a magnetic tape, but an optically recognizable security marking is preferred because a check can be carried out easily without an extensive provision of equipment or the like. Thus, it can be an immutably or unalterable marking which, as a rule, is difficult to imitate, for example, a quilloche print or a symbol, such as a heraldic animal. The marking can be applied by printing or by a photocopying process, and it can also contain individual data, for example, a serial number or second picture of the card holder.

The term "optical" security marking is intended also to include all those embodiments in which, for preparing the security marking 6, materials are used which fluoresce only when irradiated by ultraviolet light or absorb only in ultraviolet light or infrared light, and which are thus not detectable in the visible range. These internal security markings are not visible when looking at the card purely visually in reflected light, for example, in order to establish the personal particulars. The only aid required for checking security markings of this type is then a lamp which emits ultraviolet or infrared radiation so that the security marking becomes detectable when the identity card is illuminated with such a lamp.

After lamination under a pressure from about 9.8 to 20 bars (10–20 kp/cm$^2$) at elevated temperaures from about 353° to 453° K. (80°–180° C.), the cover layers 1,2 and the layers 3,4 of the card core form a laminate which is fused together as a block and which does not have any interfaces which would favor a separation. The security marking 6, for example, consisting of pigments, is then fused into the polymeric mass of the laminate.

Figure 2:
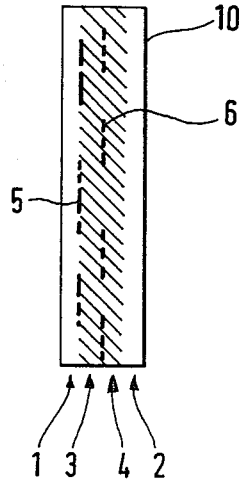
FIG. 2 is a sectional view of the identity card according to FIG. 1.

FIG. 2 illustrates a cross-section through this laminate, and the hatching of the card core, showing no boundary lines with respect to the cover layers 1,2, indicates that the matt layers are laminated without interfaces. To increase security further, the card core which is to be fused together can have more than two layers which are highly transparent and which can be provided with several latent security markings on the inside.

Figure 3:
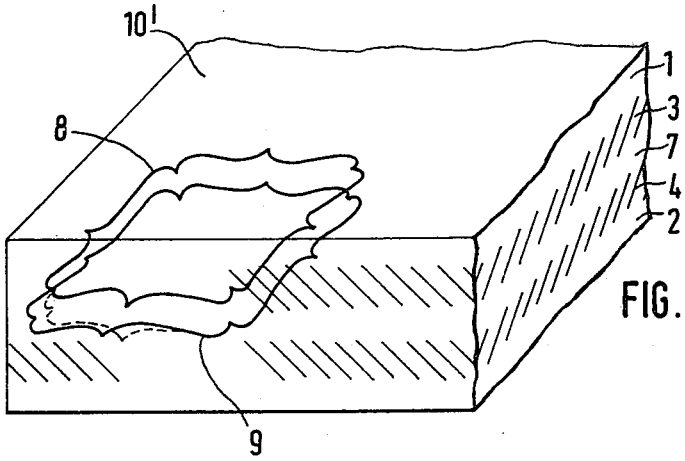
FIG. 3 is a perspective partial view of a further embodiment of an identity card according to the invention.
Figure 4:
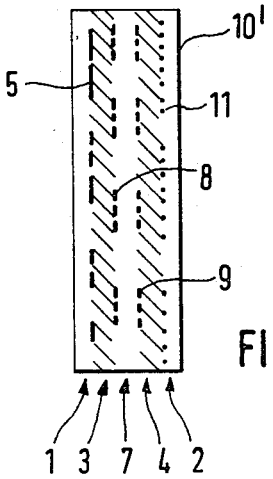
FIG. 4 is a sectional view of the identity card according to FIG. 3.

The identity card 10' shown in FIGS. 3 and 4 comprises a card core which has an additional transparent interlayer 7 carrying latent security markings 8 and 9. The transparent interlayer 7, consisting of a fusible polymer, such as a polyamide, polyvinyl chloride or the like, is bounded on both faces by the matt layers 3 and 4. In addition to arranging the layers in this manner for the purpose of security, the layer alternation in the construction of the card core between matt and transparent layers is also of practical importance for the legibility of the security markings 8 and 9. If indeed the card core were continuously matt, it would, for example at a thickness of 500 μm, have a transmittance of only a few percent, which would make it much more difficult to read the latent security markings introduced. If, however, the card core consists on the outside of matt layers 3 and 4 of, for example, 100 μm thickness each, and of a transparent interlayer 7 of, for example, 80% transmittance at a thickness of 300 μm, this gives good legibility of the latent security markings 8 and 9 introduced. The legibility of small structures, for example, in guilloche prints, increases with a decrease in thickness of the outer matt layers 3 and 4 or with less pigmentation of the outer layers 3 and 4 of the card core.

The construction of the card core from two or more layers provides an additional, very sensitive security marking in the mutual spatial correlation of the various outer and inner points of information or security markings, as is briefly explained, for example, by reference to FIG. 3. If the security markings 8 and 9 consist of guilloche figures in a congruent arrangement, an attempt to forge the identity card with the aid of heat or solvents, in order to split open the card laminate, can immediately be recognized since this leads to a complete or partial displacement of the guilloche figures relative to one another, sometimes like a moire pattern.

FIG. 3 illustrates a guilloche FIG. 9 which has been displaced relative to the guilloche FIG. 8 by manipulations, the course of the dotted line of the guilloche FIG. 9 characterizing the original position of the latter. To make it easier to distinguish between them, the respective information and the security pattern or security markings can have different colors.

The exact spatial correlation of information and security markings in the card laminate when the originally separate layers are fused together requires a highly specific laminating technique using fitting devices, such as fitting pins and fitting holes, in the individual layers and thus represent further security against subsequent forgeries. The spatial correlation of two guilloche figures can also be obtained by printing in a true fit on both sides of the interlayer 7.

FIG. 4 shows a cross-section through the identity card 10' according to FIG. 3, wherein the matt layers 3 and 4 are shown hatched and the transparent interlayer 7 is shown without hatching.

The cover layers 1,2 can additionally be provided with security markings, of which the right-hand security marking 11 is indicated in FIG. 4 by a dotted line which is interrupted at intervals. The corresponding left-hand security marking has been omitted for the sake of clarity. The security markings 11 between the card core and the cover layers 1 and 2 are likewise in a predetermined spatial arrangement relative to one another and thus give increased security against forgeries.

What is claimed is:

1. An identity card, comprising:

a single monolithic body of a single synthetic resinous material containing at least one element of visible identifying indicia and, in the interior thereof, first and second elements of an optically recognizable security indicia, said first and second elements being spaced apart from each other in the direction of the thickness of said body and being in a fixed spatial relationship with respect to each other, whereby displacement of said first and second elements relative to each other provides an indication of tampering with the identity card, said body having been made by fusing together a first layer of heat plastifiable synthetic resinous material to a first surface of a second layer of the same heat plastifiable synthetic resinous material which contains said first element of security indicia on said first surface thereof, to provide a core comprised of said fused first and second layers, and fusing to at least one outer surface of said core a third layer of the same heat plastifiable synthetic resinous material, wherein said second element of security indicia is located at the interface between said third layer and the outer surface of said core.

2. An identity card as defined by claim 1, wherein said third layer is a transparent cover layer.

3. An identity card as defined by claim 2, comprising two cover layers formed by fusing said third layer and a fifth transparent layer of heat plastifiable synthetic resin to opposite sides of said core.

4. An identity card as defined by claim 3, wherein each cover layer comprises one of said second elements of security indicia and the security indicia of said cover layers and the security indicia of said core are in a predetermined spatial arrangement relative to one another.

5. An identity card as defined by claim 1, wherein said first layer carries said visible indicia and said security indicia comprises latent indicia.

6. An identity card as defined by claim 5, wherein said latent indicia comprise guilloche figures.

7. An identity card as defined by claim 1, wherein at least one of said first and second layers comprises added pigment to produce a matt coloring.

8. An identity card as defined by claim 7, wherein at least one of said first and second layers has a white color as a result of said added pigment.

9. An identity card as defined by claim 7, wherein said core comprises said first and second layers fused to a fourth layer of heat plastifiable synthetic resinous material, wherein one of said core layers is transparent and is bounded on at least one side by one of said matt layers.

10. An identity card as defined by claim 9, wherein said transparent core layer comprises a vinyl chloride polymer provided with said first and second elements of optically recognizable security markings which are at a distance from one another equal to the thickness of said transparent core layer.

11. An identity card as defined by claim 9, wherein said first layer comprises said transparent core layer and said fourth layer is fused to the side of said first layer opposite said second layer, and wherein both said second and said fourth layer comprise said added pigment.

12. An identity card as defined by claim 7, wherein both said first and second layers include said added pigment.

13. An identity card as defined by claim 1, wherein said identifying indicia and said security indicia have different colors.

* * * * *